US006679856B2

(12) United States Patent
Mueller

(10) Patent No.: US 6,679,856 B2
(45) Date of Patent: Jan. 20, 2004

(54) MASSAGING APPARATUS WITH A CASING MOVABLE OVER THE SKIN OF A USER

(75) Inventor: Ingo Mueller, Klagenfurt (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 7 days.

(21) Appl. No.: 10/084,736

(22) Filed: Feb. 25, 2002

(65) Prior Publication Data

US 2002/0120220 A1 Aug. 29, 2002

(30) Foreign Application Priority Data

Feb. 27, 2001 (EP) ..... 01890051

(51) Int. Cl.[7] ..... A61H 23/02
(52) U.S. Cl. ..... 601/6; 604/315
(58) Field of Search ..... 601/6–11; 604/74–76, 604/73, 313, 315

(56) References Cited

U.S. PATENT DOCUMENTS

| | | | | | |
|---|---|---|---|---|---|
| 1,965,558 | A | * | 7/1934 | Weirich | 4/622 |
| 3,906,940 | A | * | 9/1975 | Kawada | 601/6 |
| RE30,500 | E | * | 2/1981 | Springer et al. | 601/131 |
| 4,729,368 | A | * | 3/1988 | Guitay | 601/123 |
| 5,665,053 | A | * | 9/1997 | Jacobs | 601/2 |
| 5,762,640 | A | * | 6/1998 | Kajiwara et al. | 604/313 |
| 5,891,064 | A | * | 4/1999 | Van Herk et al. | 601/126 |
| 6,017,320 | A | | 1/2000 | Bleeker et al. | 601/125 |
| 6,312,396 | B1 | * | 11/2001 | Muller | 601/6 |
| 6,319,212 | B1 | * | 11/2001 | Muller et al. | 601/7 |
| 6,387,103 | B2 | * | 5/2002 | Shadduck | 606/131 |
| 6,461,324 | B1 | * | 10/2002 | Schlensog | 604/74 |

FOREIGN PATENT DOCUMENTS

| | | | |
|---|---|---|---|
| WO | WO9802124 | 6/1997 | |
| WO | WO0023031 | 4/2000 | A61H/7/00 |
| WO | WO0023032 | 4/2000 | A61H/7/00 |
| WO | WO0023033 | 4/2000 | A61H/7/00 |
| WO | WO0048548 | 8/2000 | A61H/7/00 |

* cited by examiner

*Primary Examiner*—Denton D. DeMille

(57) ABSTRACT

A massaging apparatus (1) with a casing (2) with casing walls (6, 7, 8, 9) of which part (10, 11) can be placed on the skin of a user during operation and moved over the skin, and with a suction chamber (17) which is designed to open towards the skin of the user and is bounded by suction chamber walls (18, 19, 20, 21), at least part (19, 21) of which transforms, in a transitional area (22, 23), into the part (10, 11) of the casing walls (6, 7, 8, 9) which can be placed on the skin of the user, the part (10, 11) of the casing walls (6, 7, 8, 9) which can be placed on the skin of the user being structured so as to be rough with a roughness of maximum 10 $\mu$m while in the transitional area (22, 23) a roughness of 0.4 $\mu$m at the most is present.

6 Claims, 2 Drawing Sheets

MASSAGING APPARATUS WITH A CASING MOVABLE OVER THE SKIN OF A USER

FIELD OF THE INVENTION

The invention relates to a massaging apparatus with a casing comprising casing walls, part of which, can be placed on the skin of a user during operation of the massaging apparatus and moved over the skin, and with a suction chamber which opens towards the part of the casing walls which can be placed on the skin of the user and is bounded by suction chamber walls which transform into the casing walls in a transitional area.

BACKGROUND OF THE INVENTION

A massaging apparatus according to the type stated in the first paragraph above is disclosed in patent document U.S. Pat. No. 6,017,320 (PHO96508) and therefore known. Patent document U.S. Pat. No. 6,017,320 states that it has proved advantageous for the suction chamber walls to be designed rough and here have a roughness in a range between 4 $\mu$m and 8 $\mu$m. Patent document U.S. Pat. No. 6,017,320 gives no further information on the roughness of the casing walls and that part of the casing walls which is placed on the skin of the user during operation of the massaging apparatus, or on the roughness in the transitional area between the suction chamber walls and the part of the casing walls which transforms into the suction chamber walls in the transitional area. In this context, however, it should be noted that in a massaging apparatus marketed by applicant which corresponds to the massaging apparatus disclosed in patent document U.S. Pat. No. 6,017,320, the casing walls, and hence also that part of the casing walls which can be placed on the skin of the user during operation of the massaging apparatus, have a high gloss finish which in other words means that the roughness lies in a range between 0.025 $\mu$m and 0.05 $\mu$m. Because of the presence of this roughness on the known massaging apparatus, during operation of the massaging apparatus and the associated movements of the massaging apparatus over the skin of the user, the smoothness of the high gloss part of the casing walls placed on the skin of the user during operation, gives rise to an adhesion effect which has a detrimental influence on, and in extreme cases even unpleasantly impedes, the ease of movement of the massaging apparatus over the skin of the user.

SUMMARY OF THE INVENTION

It is an object of the invention to eliminate the above problem and to provide an improved massaging apparatus.

This object is achieved by a massaging apparatus according to the invention having features of to the invention such that it can be characterized as stated hereinafter:

A massaging apparatus with a casing comprising casing walls, part of which can be placed on the skin of the user during operation of the massaging apparatus and moved over the skin, and with a suction chamber which is designed to open towards the part of the casing walls which can be placed on the skin of the user and is bounded by the suction chamber walls, at least part of which transform, in a transitional area, into the part of the casing walls which can be placed on the skin of the user, where the part of the casing walls which can be placed on the skin of the user is at least mainly rough in finish, where the roughness has a value of 10 $\mu$m at the most and where a roughness of 0.4 $\mu$m at the most is present in the transitional area.

By provision of the features according to the invention it is possible, in a constructionally simple manner and with means easy to produce, to avoid an adhesion effect between the part of the casing walls placed on the skin of the user during operation and the user's skin, during movement of the massaging apparatus over the skin, so that it is ensured that the massaging apparatus can always be moved over the user's skin evenly and without detrimental hindrance. In a massaging apparatus according to the invention, an additional advantage is achieved, for the case where the roughness of the part of the casing wall which can be applied to the user's skin is selected in a range between 3.0 $\mu$m and 10 $\mu$m, that is, the advantage that with this roughness an additional scraping effect is achieved. In specialist circles this effect is known as "peeling". By the provision of the features according to the invention it is also guaranteed that, despite the rough structure of the part of the casing walls placed on the user's skin during operation of the massaging apparatus, a perfect seal is always obtained between the skin of the user and the areas of the suction chamber walls interacting with the skin of the user, so that a good and effective massage effect is always guaranteed by means of the suction chamber or the reduced pressure generated in the suction chamber.

In a massaging apparatus according to the invention the roughness of the part of the casing walls which can be applied to the skin of the user lies in a range between 1.0 $\mu$m and 3.2 $\mu$m; for these values easy maneuverability of the massaging apparatus over the user's skin is guaranteed. In a massaging apparatus according to the invention however, it has proved highly advantageous if the roughness of the part of the casing walls which can be applied to the skin of the user lies in a range between 2.5 $\mu$m and 4.0 $\mu$m. These values have proved to be the most suitable roughness values in such a massaging apparatus during frequent testing.

For a massaging apparatus according to the invention it has also proved to be highly advantageous if the roughness in the transitional area lies in a range between 0.025 and 0.05 $\mu$m. This roughness corresponds to a so-called high gloss finish.

With regard to the transitional area and the roughness in this transitional area, it should be stated here that the suction chamber and the casing of the massaging apparatus can be formed both as one piece and in the form of two separate pieces. When formed as two pieces, said transitional area with a roughness of 0.4 $\mu$m at the most can lie either in a part of the casing walls in the transitional area or in a part of the suction chamber walls in the transitional area, in both cases it must then be ensured that a perfect seal exists between the two adjacent separate pieces.

For a massaging apparatus according to the invention it has proved particularly advantageous if the roughness of 0.4 $\mu$m at the most in the transitional area is provided in a ring-like closed end zone of the suction chamber walls. On operation of the massaging apparatus such a design ensures a particularly good seal between the user's skin and the transitional area, and hence the inside of the suction chamber, so that it is always ensured that the reduced pressure necessary for a perfect massage effect is maintained in the suction chamber.

For a massaging apparatus according to the invention it has also proved advantageous if the parts of the suction chamber walls lying inside the suction chamber in relation to the ring-like closed end zone of the walls are formed just as roughly because this known measure offers, even for a device according to the invention, the additional advantage that an undesirable adhesion effect does not occur between a skin fold drawn into the suction chamber and the suction chamber walls. In this context it has proved favorable if the roughness within the suction chamber is at the most 10 μm; however, it has proved to be particularly advantageous if this roughness lies in the range between 1.0 μm and 5.0 μm and preferably between 1.5 μm and 2.0 μm.

BRIEF DESCRIPTION OF THE DRAWINGS

The above aspects and further aspects of the invention will become apparent from the embodiment described and explained hereinafter by way of example.

The invention will now be described in detail on basis of an embodiment shown in the drawings, however without the invention being restricted thereto in any way.

DETAILED DESCRIPTION OF THE PREFERRED EMBODIMENTS

Figure 1:
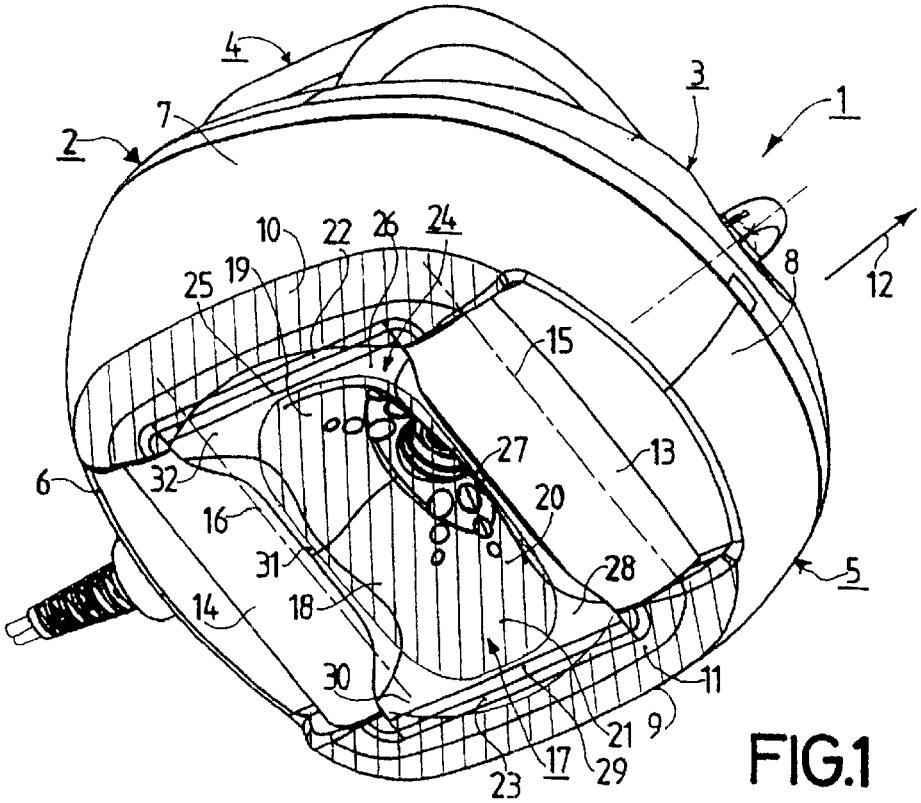
FIG. 1 is a first oblique view from below of an embodiment of a massaging apparatus according to the invention in which walls areas having 2 relatively high roughness are marked with hatching.

FIGS. 1 to 4 show a massaging apparatus 1. With regard to this massaging apparatus 1 and some important features and measures in relation to the structure of this massaging apparatus 1, reference can be made to the following patent documents:

WO 00/23031 A1 (PHO 98.541)

WO 00/23032 A1 (PHO 98.542)

WO 00/23033 A1 (PHO 98.543)

WO 00/48548 A1 (PHO 99.504)

Taking into account the above patent documents, essentially the description below concerns only the new and inventive features and measures in the massaging apparatus 1 according to FIGS. 1 to 4.

The massaging apparatus 1 has a casing 2. The casing 2 consists of a casing upper part 3, to which is connected an elastic retaining bracket 4, and a casing lower part 5. The casing 2 consists of ring-shaped casing walls 6, 7, 8 and 9 which transform into each other and are curved or bent in the height direction of the massaging apparatus 1. A part 10 and 11 of these casing walls 6, 7, 8 and 9 can be placed on the skin of the user during operation of the massaging apparatus 1 and moved over the skin. With regard to the movement of the massaging apparatus 1 over the skin of the user it should be stated that for massaging apparatus 1 this movement takes place mainly in a direction indicated by arrow 12 in one of FIGS. 1 to 4. The reason for this is essentially that the massaging apparatus 1 is fitted with two rollers 13 and 14, whose roller axes 15 and 16 and directions of rotation, defined by the roller axes 15 and 16, essentially determine the operating direction 12.

The massaging apparatus 1 also has a suction chamber 17. The suction chamber 17 is designed to open towards the parts 10 and 11 of casing walls 6, 7, 8 and 9 which can be placed on the skin of the user and essentially takes the shape of a type of bell or dome. The suction chamber 17 is bounded by suction chamber walls 18, 19, 20 and 21 which are designed so as to be curved in conformity with the bell or dome shape and transform smoothly into each other. Part of the suction chamber walls 18, 19, 20 and 21 namely the two walls 19 and 21, transform in a transitional area 22 and 23 into the part 10 and 11 of the casing walls 6, 7, 8 and 9 which can be placed on the skin of the user.

Figure 2:
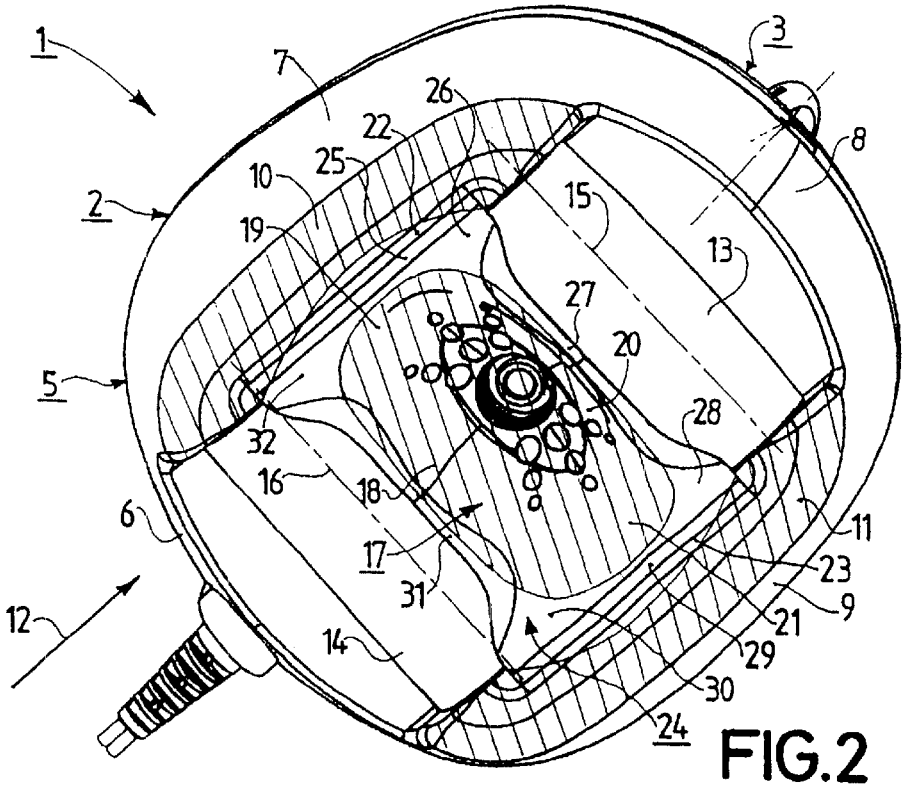
FIG. 2 is a second oblique view from below of the massaging apparatus according to FIG. 1.
Figure 3:
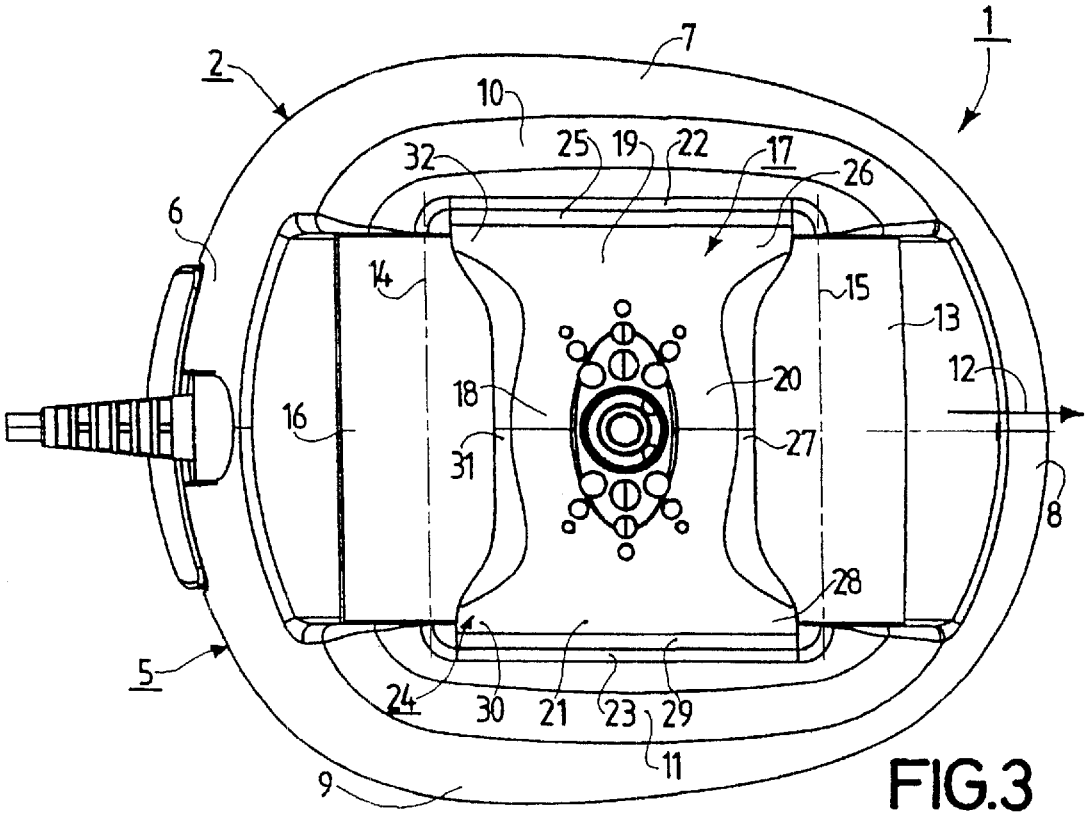
FIG. 3 is a view from below of the massaging apparatus according to FIGS. 1 and 2.
Figure 4:
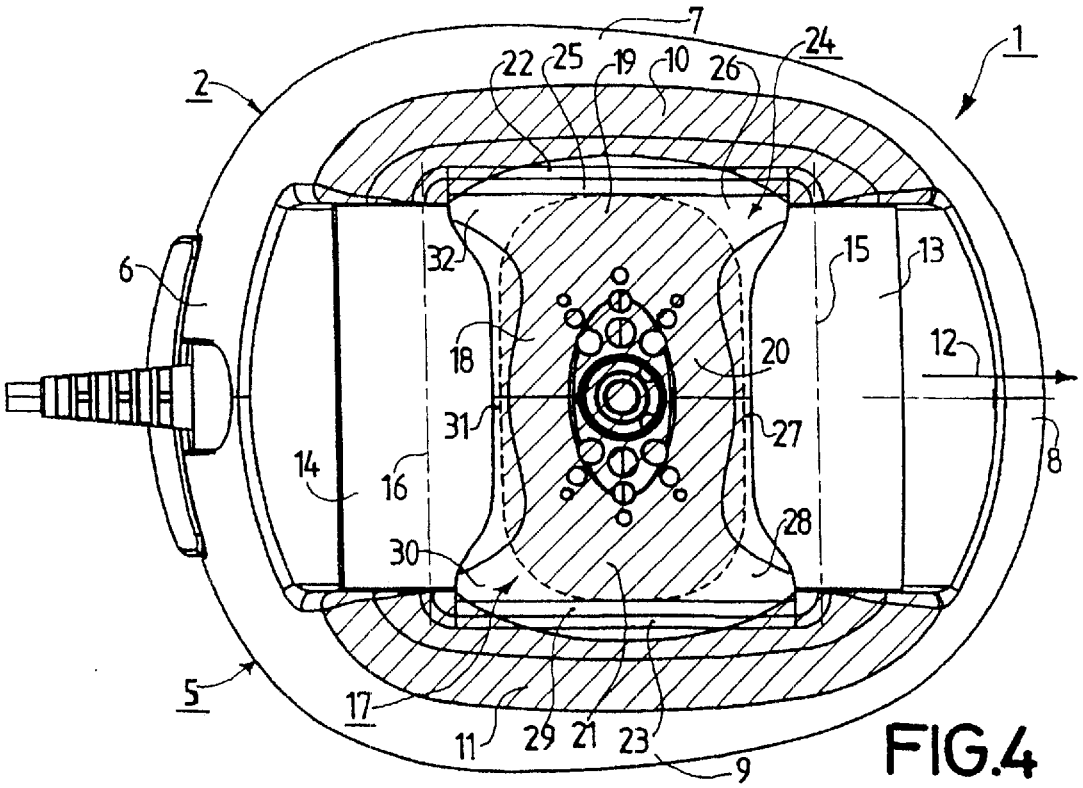
FIG. 4 is a view similar to FIG. 3 of the massaging apparatus according to FIGS. 1, 2, and 3 in which wall areas having a relatively high roughness are marked with hatching as in FIGS. 1 and 2.

For the massaging apparatus 1 advantageously the structure is such that the parts 10 and 11 of the casing walls 6, 7, 8 and 9 which can be placed on the skin of the user are designed so as to be totally rough, which in the present case is indicated in FIGS. 1, 2 and 4 by hatch marking of the part 10 and 11 of the casing walls 6, 7, 8 and 9 to be placed on the skin of the user. The roughness of the part 10 and 11 of the casing walls 6, 7, 8 and 9 which can be placed on the skin of the user has a value in a range between 0.5 μm and 4.0 μm. However, other roughness values are also possible but not less than 0.1 μm and not more than 10.0 μm.

Furthermore, for the massaging apparatus 1 it is advantageously provided that in the transitional area 22 and 23 the roughness lies in a range between 0.025 μm and 0.05 μm, said value corresponding to a high gloss finish. However a slightly higher roughness can be present but nonetheless guarantee a good seal effect, be it that the roughness should not be more than 0.4 μm. For the massaging apparatus 1 the design is also such that the roughness present in the transitional area 22 and 23 which lies in the range between 0.025 μm and 0.05 μm lies in a ring-like closed end zone 24 of the suction chamber walls 18, 19, 20 and 21, which end zone 24 is composed of the end zone sections listed below, that is a first end zone section 25 adjacent to casing wall 7, and a first transitional section 26 which starts from the first end zone section 25 and leads to a narrow second end zone section 27 which extends essentially parallel to the first roller 13, to and is adjoined by a second transitional section 28. The second transitional section 28 is followed by a third end zone section 29 adjacent to casing wall 9. Then follows a third transitional section 30 which transforms into another narrow, fourth end zone section 31 adjacent to the second roller 14 and followed by a fourth transitional section 32 which finally transforms into the first end zone section 25. Using the ring-like closed end zone 24, having a high gloss finish, a particularly good seal is achieved between the inside of the suction chamber 17 and the skin of the user on which the massaging apparatus 1 is placed by way of the part 10 and 11 of the casing walls 6, 7, 8 and 9.

In the massaging apparatus 1 the areas of the suction chamber walls 18, 19, 20 and 21 opposite the ring-like closed end zone 24 of the walls 18, 19, 20 and 21 inside the suction chamber 17 are structured so as to be rough, the roughness having a value in the range between 1.5 μm and 2.0 μm. The roughness can however also have other values but not less than 1.0 μm and not more than 10.0 μm. Due to the roughness inside the suction chamber 17 an adhesion effect is avoided between the suction chamber walls 18, 19, 20 and 21 inside the suction chamber 17 and a skin fold drawn into the suction chamber 17.

By structuring the part 10 and 11 of the casing walls 6, 7, 8 and 9 of the massaging apparatus 1 which can be placed on the skin of the user such that it has the roughness given above, and by providing a roughness corresponding to a high gloss finish in the transitional zone 22 and 23 described above, in this case being part of the ring-like closed end zone 24 of the suction chamber walls 18, 19, 20 and 21, it is achieved in a simple manner that firstly no adhesion effect occurs between the part 10 and 11 of the casing walls 6, 7, 8 and 9 placed on the skin of the user during use of the massaging apparatus 1 and the cooperating skin, so that the massaging apparatus 1 can be moved over the skin easily and smoothly and without excess force being required, and that secondly a perfect seal is always ensured between the inside of suction chamber 17 and the skin to be treated, so that adequate reduced pressure is always maintained in the suction chamber 17 and hence always a perfect massage effect, is achieved.

What is claimed is:

1. A massaging apparatus (1) with a casing (2) comprising casing walls (6, 7, 8, 9), part (10, 11) of which can be placed on the skin of the user during operation of the massaging apparatus (1) and moved over the skin, and with a suction chamber (17) which is designed to open towards the part (10, 11) of the casing walls (6, 7, 8, 9) which can be placed on the skin of the user and is bounded by the suction chamber walls (18, 19, 20, 21), at least part of which transform, in a transitional area (22, 23), into the part (10, 11) of the casing walls (6, 7, 8, 9) which can be placed on the skin of the user, where the part (10, 11) of the casing walls (6, 7, 8, 9) which can be placed on the skin of the user is non-rotational and at least mainly rough in finish, where the roughness has a value in the range of 0.1 $\mu$m to 10 $\mu$m and a roughness of 0.4 $\mu$m is at the most present in the transitional area (22, 23).

2. A massaging apparatus (1) as claimed in claim 1, where the roughness of the part (10, 11) of the casing walls (6, 7, 8, 9) which can be placed on the skin of a user lies in a range between 2.5 $\mu$m and 4.0 $\mu$m.

3. A massaging apparatus (1) as claimed in to claim 1, where the roughness in the transitional area (22, 23) lies in a range between 0.025 $\mu$m and 0.05 $\mu$m.

4. A massaging apparatus (1) as claimed in to claim 1, where the roughness of 0.4 $\mu$m at the most in the transitional area (22, 23) is provided in a ring-like closed end zone (24) of the suction chamber walls (18, 19, 20, 21).

5. A massaging apparatus (1) as claimed in to claim 4, where the area of the suction chamber walls (18, 19, 20, 21) lying opposite the ring-like closed end zone (24) of the suction chamber walls (18, 19, 20, 21) inside the suction chamber (17) is structured so as to be rough, the roughness having a value of 10 $\mu$m at the most.

6. A massaging apparatus (1) as claimed in claim 5, where the roughness of the areas of the suction chamber walls (18, 19, 20, 21) lying opposite the ring-like closed end zone (24) of the chamber walls (18, 19, 20, 21) inside the suction chamber (17) lies in a range between 1.5 $\mu$m and 2.0 $\mu$m.

* * * * *